US007070540B1

(12) United States Patent
Priester

(10) Patent No.: US 7,070,540 B1
(45) Date of Patent: Jul. 4, 2006

(54) ATHLETE TRAINING DEVICE

(76) Inventor: Joshua Priester, 1780 Polk St., Apt. C, Eugene, OR (US) 97402

( * ) Notice: Subject to any disclaimer, the term of this patent is extended or adjusted under 35 U.S.C. 154(b) by 475 days.

(21) Appl. No.: 10/447,392

(22) Filed: May 28, 2003

(51) Int. Cl.
*A63B 69/00* (2006.01)
*A63B 5/16* (2006.01)

(52) U.S. Cl. ..... 482/14; 482/26; 482/148; 482/908; 14/69.5; 472/88; 472/92

(58) Field of Classification Search ..... 482/14, 482/15, 19, 20, 23, 26, 30, 32, 79, 140, 142, 482/145, 146, 148, 907, 908; 472/92, 88, 472/89; 14/69.5; D21/800; 119/847–849
See application file for complete search history.

(56) References Cited

U.S. PATENT DOCUMENTS

| | | | | | |
|---|---|---|---|---|---|
| 963,918 | A | | 7/1910 | Miller | |
| 2,076,069 | A | * | 4/1937 | Davis | 254/88 |
| 2,144,962 | A | * | 1/1939 | Bresnahan | 482/19 |
| 3,297,320 | A | * | 1/1967 | Di Benedetto | 482/148 |
| 3,401,931 | A | * | 9/1968 | McCafferty et al. | 482/19 |
| 3,534,956 | A | | 10/1970 | Myers | |
| 3,746,335 | A | * | 7/1973 | Fichter et al. | 482/19 |
| 3,839,761 | A | | 10/1974 | Stevenson | |
| 4,013,268 | A | * | 3/1977 | Williams | 254/88 |
| 4,129,916 | A | | 12/1978 | Schlesinger et al. | |
| 4,285,514 | A | * | 8/1981 | Romero | 472/89 |
| 4,483,073 | A | | 11/1984 | Johnson | |
| 4,693,470 | A | * | 9/1987 | Ogawa | 482/79 |
| 4,892,302 | A | | 1/1990 | Daigle | |
| 4,986,405 | A | | 1/1991 | Alten | |
| 5,087,036 | A | * | 2/1992 | Cooper | 482/79 |
| 5,125,650 | A | * | 6/1992 | Paris | 482/142 |
| 5,234,396 | A | * | 8/1993 | Wilkinson | 482/142 |
| 5,341,533 | A | | 8/1994 | Seitz | |
| 5,599,235 | A | | 2/1997 | Lynberg | |
| 5,620,404 | A | * | 4/1997 | Eyman | 482/142 |
| 5,784,740 | A | | 7/1998 | DiSieno et al. | |
| 5,842,954 | A | | 12/1998 | Slupskiy | |
| 5,879,272 | A | * | 3/1999 | Mekjian | 482/51 |
| 5,894,618 | A | * | 4/1999 | Jacobsen et al. | 14/69.5 |
| 5,944,640 | A | * | 8/1999 | Larsson | 482/96 |
| 6,135,921 | A | | 10/2000 | Holland et al. | |
| 6,484,343 | B1 | * | 11/2002 | Phillips | 14/69.5 |
| 6,494,812 | B1 | * | 12/2002 | Grimes, Jr. | 482/14 |
| 6,554,748 | B1 | * | 4/2003 | Tollner | 482/51 |
| 6,921,339 | B1 | * | 7/2005 | Martin et al. | 472/89 |
| 6,926,643 | B1 | * | 8/2005 | Gvoich | 482/52 |

* cited by examiner

*Primary Examiner*—Gregory L. Huson
*Assistant Examiner*—Victor K. Hwang
(74) *Attorney, Agent, or Firm*—Mark A. Bauman

(57) ABSTRACT

The present invention is an athlete training device and method useful in training athletes for track and field events including the high jump, pole vault, discus, long jump and shot put. The ramp may be adjusted to a number of discrete ramp angles with the use of either supports and stops or supports and channels.

9 Claims, 3 Drawing Sheets

ATHLETE TRAINING DEVICE

TECHNICAL FIELD

The present invention relates to an apparatus and method for training athletes for various track and field events including the high jump, pole vault, long jump, shot put and discus.

BACKGROUND OF THE INVENTION

There are a variety of known methods and apparatuses that are used to help individuals improve their training efficiency for various track and field events. An example of such a training apparatus is seen in U.S. Pat. No. 6,135,921 to Holland et al. The apparatus is designed to assist individuals training for the long jump and is used in conjunction with a launching board positioned on a runway. The apparatus contains a lower flexible member which the jumper's legs cross over and an upper flexible member configured to contact the jumper's chest during the jump. The apparatus is designed to improve both the jumper's jump distance and trajectory. Unfortunately, the usefulness of this device is limited to the long jump and has only nominal utility for other track and field events.

Another example of a jump training device is shown in U.S. Pat. No. 5,842,954 to Slumpskiy. This device is designed to help the athlete perform plyometric exercises which help to build speed-power capabilities of the athlete. However, its application is also limited to jumping events.

An inclined launch ramp employing a fixed slope is occasionally used to assist athletes in their training programs for jumping events. Such launch ramps have exit heights ranging from six to nine inches. Unfortunately, these ramps are not widely used because they do not significantly improve athlete performance.

In addition, many track and field programs have limited budgets and are not able to purchase specialized equipment for each event. Often, only basic equipment required to meet the competitive requirements are purchased and other specialized accessories used for training are not utilized due to their high cost and limited usefulness. For this reason, there is a strong need for versatile equipment that has multiple uses rather than equipment that is designed for a single event.

Also, over the years, ramps have been designed and built using various materials for various purposes. For example, ramps have been used to carry wheeled vehicles and wheelchairs from one location to another. Some of these ramps are adjustable using various adjustment means. However, most of these ramps are either permanently installed or difficult to relocate.

There is also a need for a track and field event training method that is less strenuous on the body and allows the athlete more time in the air to improve technique during practicing. Less strenuous methods are known to reduce the risk of injury.

The subject invention for athlete training device and method overcomes the perceived shortcomings and detriments in the prior art apparatuses and methods and is the subject of the present patent.

SUMMARY OF THE INVENTION

Therefore, one aspect of the present invention is to provide an athlete training apparatus having a base, a frame with a launch surface borne by the frame having an exit height, and also a pivot connection between the base and the frame, a plurality of supports configured to hold the frame at the ramp angle, a linkage system configured to maintain the supports in an approximately equal tilt angle, and a handle connected to the linkage system configured to position the supports. In addition, the present invention may also include a plurality of sets of stops connected to the frame, wherein each set of stops is associated with each support and wherein each stop within the set is configured to hold the launch surface at one of several discrete exit heights. Further, this same present invention may also include a frame and base which are proportioned such that the outside perimeter of the base is less than the inside perimeter of the frame. And yet further, the exit height of the present invention may be configured to various discrete heights including two, four, six and eight inches. The shape of the launch surface may also have a front portion with an arcuate shape, and wherein the arcuate shape approximates the shape of a standard shot put circle. Further, the athlete training apparatus may be built using light weight materials to allow the apparatus to be easily relocated.

Another aspect of the present invention is to provide an athlete training apparatus having a base, a frame with a launch surface borne by the frame having an exit height, and also a pivot connection between the base and the frame, a plurality of supports configured to hold the frame at the ramp angle, a linkage system configured to maintain the supports in an approximately equal tilt angle, and a handle connected to the linkage system configured to position the supports. In addition, the present invention may also include a plurality of channels formed into the base configured to hold the linkage system in position wherein each channel defines discrete exit heights. Further, this same aspect of the invention may also include a frame and base which are proportioned such that the outside perimeter of the base is less than the inside perimeter of the frame. And yet further, the exit height of the present invention may be configured to various discrete heights including two, four, six and eight inches. The shape of the launch surface may also have a front portion with an arced shape, and wherein the arcuate shape approximates the shape of a standard shot put circle. Further, the athlete training apparatus may be built using light weight materials to allow the apparatus to be easily relocated.

Yet another aspect of the present invention is to provide an apparatus for assisting an athlete in training for various track and field events, including a base for resting on the surface of an athletic field, a launch surface having a rear portion with an elevation approximately equal to the elevation of the athletic field and a front portion having an exit height which is adjustable in fixed increments which may be equal to two inch increments and possible having the lowest exit height of two inches and the highest exit height of eight inches.

Yet another aspect of the present invention is to provide a method for training an athlete for a jumping event wherein the jumping event includes an athletic field, a landing pit, a goal (which could include clearing a high jump standard, clearing a pole vault standard or traveling a long jump distance) and an adjustable ramp comprising a base for resting on the surface of the athletic field, a launch surface having a rear portion with an height approximately equal to the elevation of the athletic field and a front portion having an exit height which is adjustable in fixed increments having a maximum and minimum exit heights, comprising configuring the ramp to provide its maximum exit height, repetitively jumping from the ramp and traveling into the landing pit while attempting to reach the goal, until the goal is achieved consistently, re-configuring the ramp to provide an exit height which is one increment lower than its maximum exit height, repetitively jumping from the ramp and traveling into the landing pit while attempting to reach the goal, until the goal is achieved consistently, re-configuring the ramp to provide an exit height which is two increments lower than its maximum exit height, repetitively jumping from the ramp and traveling into the landing pit while attempting to reach the goal, until the goal is achieved consistently, re-configuring the ramp to provide an exit height which is three increments lower than its maximum exit height, repetitively jumping from the ramp and traveling into the landing pit while attempting to reach the goal, until the goal is achieved consistently, and re-configuring the ramp to provide an exit height which is equal to its minimum exit height, and repetitively jumping from the ramp and traveling into the landing pit while attempting to reach the goal, until the goal is achieved consistently. This maximum exit height may be eight inches and the minimum exit height could be two inches.

Another aspect of the invention is to provide a method for training an athlete for a throwing event wherein the throwing event includes an athletic field, an object (which could include the javelin, discus or shot put) to be thrown, a goal, and an adjustable ramp comprising a base for resting on the surface of the athletic field, a launch surface having a rear portion with an height approximately equal to the elevation of the athletic field and a front portion having an exit height which is adjustable in fixed increments having both maximum and minimum exit heights, including configuring the adjustable ramp to an initial exit height of one increment higher than the minimum exit height, repetitively throwing the object and attempting to direct the next step after the object is thrown toward the forward direction of the adjustable ramp and continuing until the goal is reached, reconfiguring the adjustable ramp to an exit height which is the next increment higher, repetitively throwing the object and attempting to direct the next step after the object is thrown toward the forward direction of the adjustable ramp and continuing until the goal is reached, reconfiguring the adjustable ramp to an exit height which is the next increment higher. Still further, the maximum exit height could be eight inches and the minimum height could be two inches.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
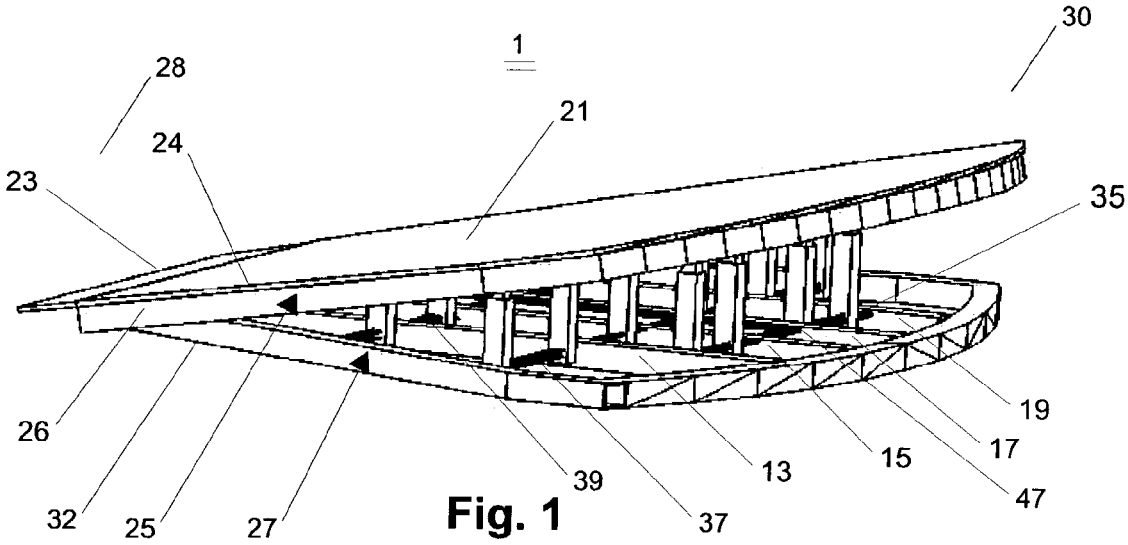
FIG. 1 is a perspective view of the adjustable ramp in its fully extended position.

One embodiment of the versatile track and field training apparatus of the present invention is generally indicated by the numeral 1 in FIG. 1. The ramp 1 is forty-eight inches wide at its widest point near the front 30. The front 30 of the ramp extends outwardly in an arc with a radius of forty-two inches. The dimensions of this arc match the radius of a standard shot put circle. The distance from the middle of the rear 28 of the adjustable ramp 1 to the center of the arc at the front 30 is forty-two inches. The exit height 22 (FIG. 2) is measured from the bottom of the base 27 and is adjustable from a setting of two inches to a fully extended height of eight inches.

The adjustable ramp 1 includes a launch surface 21 affixed to the top of the frame 25. In this embodiment, the launch surface 21 is an athletic all-weather rubber material. The frame 25 includes a top launch plate 24 that is welded to a frame tube 26 that generally follows the perimeter of the launch surface 21. In one embodiment, the launch plate 24 is made with ¼" aluminum or steel plate and is welded to the frame tube 26 which is a weldment comprised of 1-¼"×1-¼"×⅛" inch aluminum or steel tubes.

The adjustable ramp 1 has a tail section 23 that is twenty-three inches wide and is pivotally connected to the launch plate 24 with a hinge (not shown) which provides a smooth transition between the surface of the athletic field and the launch surface 21.

The base 27 is configured to rest on the surface of the athletic field and is composed of a base tube 32 with an outside perimeter which generally follows the inside perimeter frame tube 26 and a longitudinally positioned first base support tube 13, second base support tube 15, third base support tube 17 and fourth base support tube 19. Each support tube 13, 15, 17 and 19 is uniformly spaced relative to each other and each is welded to the inside of the base tube 32. In this embodiment, all tubes are 1-¼"×1-¼"×⅛" aluminum or steel tubes.

Figure 2:
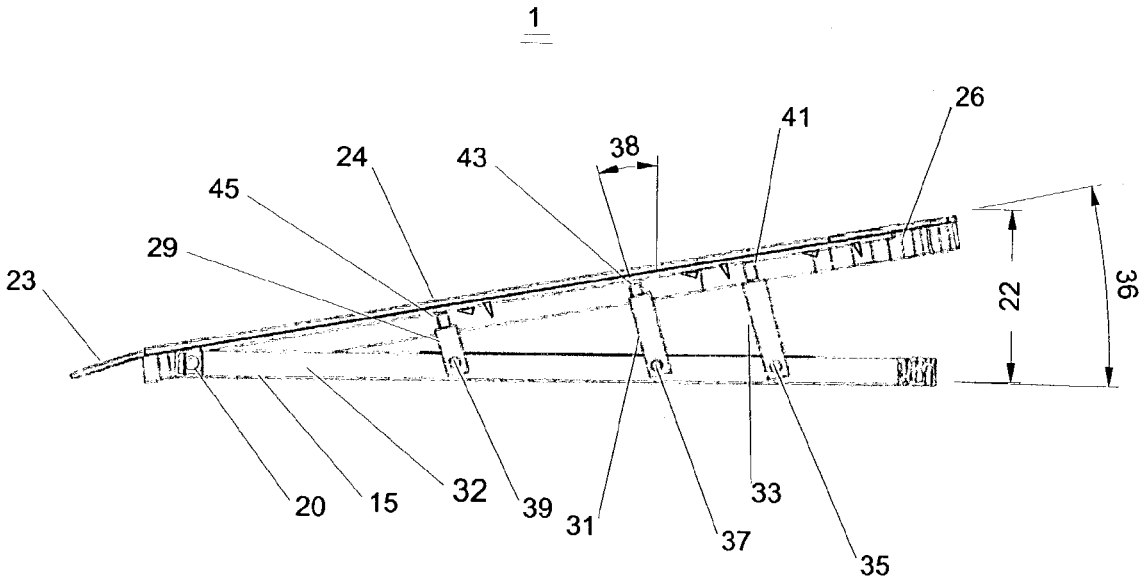
FIG. 2 is a section view of the adjustable ramp configured to an eight inch position.

A base pivot 20 (FIG. 2) allows the frame 25 to pivot relative to the base 27 to form a ramp angle 36 (FIG. 2). The base pivot 20 is positioned to allow the base tube 32 to nest within the frame tube 26 when the adjustable ramp 1 is configured in its lowest position.

The frame 25 is supported from the base 27 by four front supports 33 (FIG. 2), six middle supports 31 (FIG. 2) and four rear supports 29 (FIG. 2). The front supports 33 (FIG. 2) are each welded to the front support rod 35. The front support rod 35 is routed through apertures in the first based support tube 13, the second base support tube 15, the third base support tube 17 and the fourth base support tube 19 forming a pivot for the front supports 33 (FIG. 2).

The middle supports 31 (FIG. 2) are each welded to the middle support rod 37. The middle support rod 37 is routed through apertures in the first based support tube 13, the second base support tube 15, the third base support tube 17 and the fourth base support tube 19 forming a pivot for the middle supports 31 as well as the base tube 32.

The rear support rod 39 is routed through apertures in the first base support tube 13, the second base support tube 15, the third base support tube 17 and the fourth base support tube 19 forming a pivot for the rear supports 29 (FIG. 2) as well as the base tube 32.

The front support rod 35, middle support rod 37 and rear support rod 39 each have a welded arm (not shown) which extends radially outward from each rod and connects to the position link rod 47 whose end acts as a handle. This position link rod 47 ties the rear supports 29 (FIG. 2), middle supports 31 (FIG. 2) and front supports 33 (FIG. 2) forming a linkage system that together acts to control their tilt angle 38 (FIG. 2) to select an exit height 22.

Now referring to FIG. 2, the adjustable ramp 1 is shown configured with an exit height 22 of eight inches. The launch surface 21 is held in position by a system of adjustable supports and sets of stops, which will now be described.

The rear support rod 39, middle support rod 37 and front support rod 35 are shown positioned within apertures in the second base support tube 15. The rear supports 29 are shown welded to the rear support rod 39. The rear supports 29 are held in position by rear eight inch stops 45 which are rods welded to the top launch plate 24. There are four rear eight inch stops 45 each corresponding to one of the rear supports 29. The rear supports 29 are made of 1-¼"×1-¼" aluminum or steel tubing and the rear support rod 39 is an aluminum or steel.

The middle supports 31 are shown welded the middle support rod 37. The middle supports 31 are held in position by the middle eight inch stops 43 which are rods welded to the top launch plate 24. There are six middle eight inch stops 43 each corresponding to one of the middle supports 31. The middle supports 31 are made of 1-¼"×1-¼" aluminum or steel tubing and the middle support rod 37 is an aluminum or steel rod.

The front supports 33 are shown welded to the front support rod 35. The front supports 33 are held in position by the front eight inch stops 41 which are rods welded to the top launch plate 24. There are four front eight inch stops 41 each corresponding to one of the front supports 33. The front supports 33 are made of 1-¼"×1-¼" aluminum or steel tubing and the front support rod 35 is an aluminum or steel rod.

Figure 3:
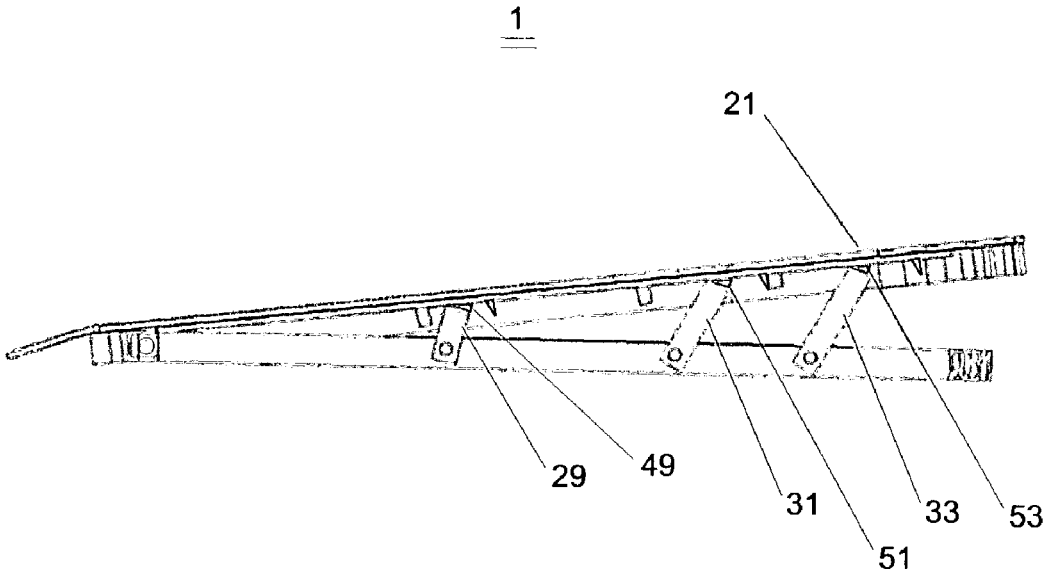
FIG. 3 is a section view of the adjustable ramp configured to a six inch position.

Now referring to FIG. 3, the adjustable ramp 1 is shown with exit height 22 (FIG. 2) at a height of six inches. The launch surface 21 is held in this position by a system of adjustable supports and stops, which will now be described.

In this position, the rear supports 29 are now in contact with the rear six inch stops 49. Similarly, the middle supports 31 are in contact with the middle six inch stops 51 and the front supports 33 are now in contact with front six inch stops 53. The angle of incline is similar between the rear supports 29, middle supports 31, and front supports 33.

Figure 4:
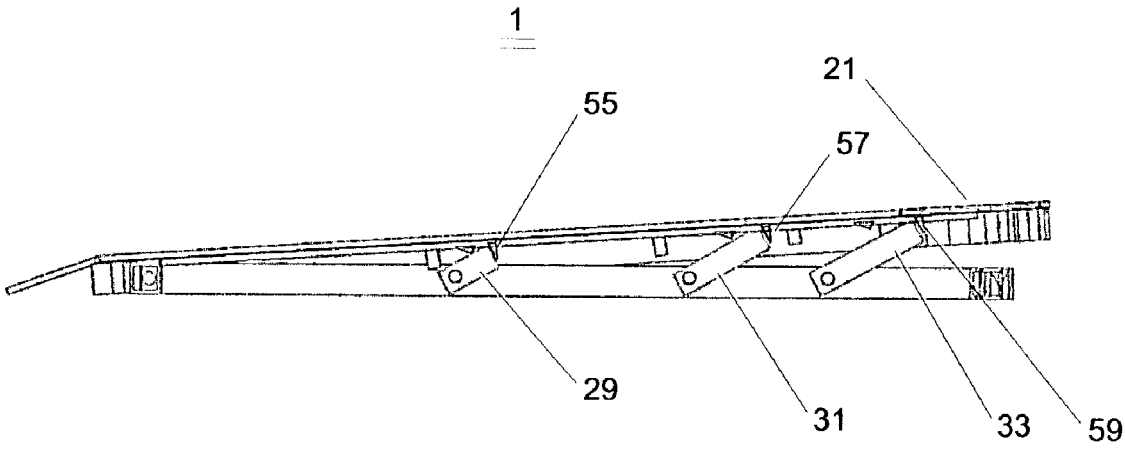
FIG. 4 is a section view of the adjustable ramp configured to a four inch position.

Now referring to FIG. 4, the adjustable ramp 1 is shown with exit height 22 (FIG. 2) at a height of four inches. The launch surface 21 is held in position by a system of adjustable supports and stops, which will now be described.

The rear supports 29 are shown in contact with rear four inch stops 55. Similarly, the middle supports 31 are in contact with the middle four inch stops 57 and front supports 33 are in contact with the front four inch stops 59. The angle of incline is similar between the rear supports 29, middle supports 31, and front supports 33.

Figure 5:
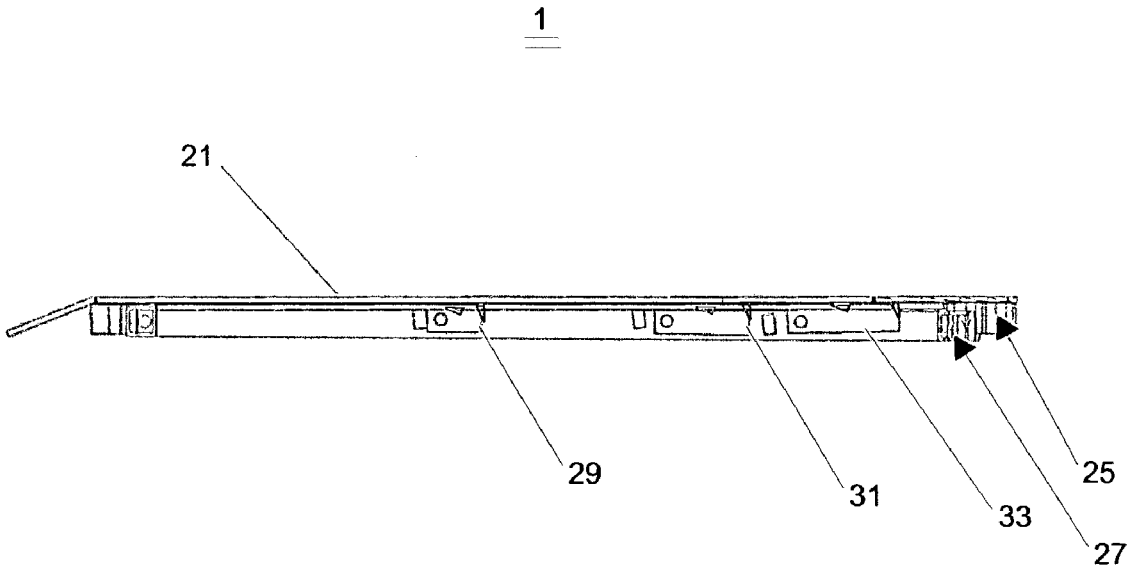
FIG. 5 is a section view of the adjustable ramp configured to a two inch position.

Now referring to FIG. 5, the adjustable ramp 1 is shown with exit height 22 (FIG. 2) of two inches. Here, the launch surface 21 is simply resting at its lowest position with the frame 25 nested over the base 27. The rear supports 29, middle supports 31 and front supports 33 are not connected to any stops.

Figure 6:
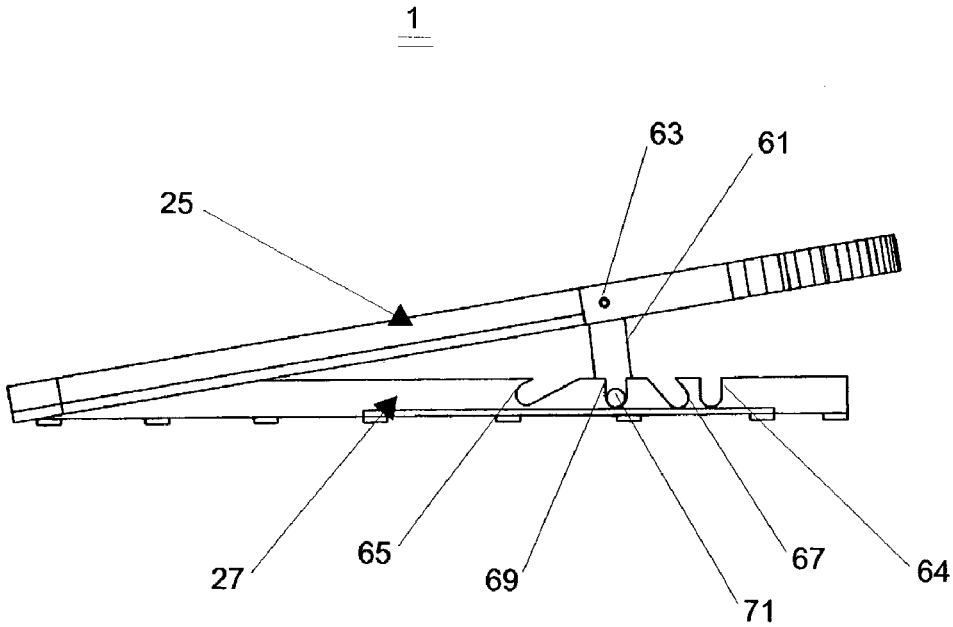
FIG. 6 is a side view of an alternative embodiment of the adjustable ramp its fully extended position.

Another embodiment of the adjustable ramp 1 is shown in FIG. 6. Here the adjustable ramp 1 is shown with an alternate means for supporting the frame 25 in relation to the base 27 using a single row of supports 61 which pivot together along the support rod 63 which is mounted within apertures located on opposite faces of the frame 25 forming a linkage system to change the tilt angle 38 (FIG. 2) of the supports 61.

The supports 61 are each welded to a transverse catch rod 71, whose end also acts as a handle, which is configured to rest within one of four channels to lock the frame 25 into position. For example, the catch rod 71 is shown resting in the eight inch channel 69. The catch rod 71 could be positioned in the six inch channel 67 to provide an exit height 22 (FIG. 2) of six inches. Alternatively, the catch rod 71 could also be placed in the four inch channel 65 to provide an exit height 22 (FIG. 2) of four inches. Further, the catch rod 71 could be placed into the two inch channel 64 to provide an exit height 22 (FIG. 2) of two inches.

The adjustable ramp 1 may be fabricated using light weight materials to improve portability. Alternatively, it may be configured with a set of wheels (not shown) to provide further ease of movement. Further, in the embodiments shown and described utilize two inch exit height 22 increments and a maximum exit height 22 of eight inches. One skilled in the art would readily recognize that the design and construction of the ramp could be changed to provide other increments and maximum exit heights.

Operation

The operation of the described embodiment of the present invention is believed to be readily apparent and are briefly summarized at this point.

The adjustable ramp 1 in FIG. 1 may be reconfigured from one exit height 22 (FIG. 2) to another exit height 22 (FIG. 2) by manually lifting the front 30 of the frame 25 and simultaneously pushing or pulling the position link rod 47 to its desired position.

The adjustable ramp 1 as shown in FIG. 6 may be reconfigured from one exit height 22 (FIG. 2) to another exit height 22 (FIG. 2) by lifting the frame 25 from one of the sides and simultaneously repositioning the catch rod 71 into either one of the eight inch channel 69, six inch channel 67, four inch channel 65 or two inch channel 64.

When used for preparing for a track and field event, an athlete will use the adjustable ramp 1 to improve training efficiency. This is accomplished by helping the athlete manage available energy so he can concentrate on technique. The athlete has a limited number of attempts in a practice session before the leg muscles become lethargic so it is important that the energy expended by the athlete be concentrated toward improving that portion of the event that is the limiting factor in accomplishing the desired improvement. For jumping events (which include the high jump, pole vault and long jump) this limiting factor is often the athlete's technique as they attempt to clear a bar or get a distance into a pit.

For jumping events, having an exit height 22 (FIG. 2) higher than the level of the athletic field enables an athlete to increase the amount of time they are traveling through the air which provides more time during each jump to concentrate on technique. This increase in the amount of time through the air is achieved because the height of the launching point (which is slightly lower than the exit height 22) is raised with respect to the landing point which increases the path length for a given jump.

For example when an athlete desires to improve jumping technique in the high jump, pole vault or long jump events, the athlete positions the adjustable ramp 1 to an exit height 22 of eight inches using one of the previously described methods. In addition, the athlete sets a goal which is just slightly beyond their present ability. As they proceed to practice using the adjustable ramp 1 in this position and improve their technique they will eventually reach their goal consistently. At this point, the athlete lowers the adjustable ramp 1 to an exit height 22 of six inches. Initially in this position, the athlete may not achieve his goal and must practice with the adjustable ramp 1 in this position until the goal is reached consistently. Once again, the athlete will lower the adjustable ramp 1 to an exit height 22 of four inches. The athlete may not initially achieve his goal and must practice using the ramp in this position until the goal is reached consistently. Once again, the athlete will lower the adjustable ramp 1 to an exit height 22 of two inches. The athlete may not initially achieve his goal and must practice using the ramp in this position until the goal is reached consistently. Finally, once the goal is achieved consistently at an exit height 22 of two inches, the adjustable ramp 1 is removed and the standard launchpad (not shown) on the athletic field is used until the goal is reached consistently. One skilled in the art will note that there are variations in this example which could be used to achieve the same result. For example, the exit height 22 positions could be configured in different increments or one of the positions might be skipped.

Further, in the pole vault event, use of the ramp in this manner also enables the athlete to use a longer and more heavily weighted pole.

The adjustable ramp 1 may also be used by an athlete to improve efficiency and effectiveness in training for the discus and shot put events. To be effective in these events, an athlete must transfer his weight from one leg to the other as they are throwing the implement. An effective point to release the implement is at the point where the athlete's blocking leg (the left leg for a right-handed person) is at its highest point. The athlete must thrust his hips up and toward the throwing direction in order to transfer the weight to the blocking leg. The adjustable ramp 1 provides an immediate feedback to the athlete by making it harder for the athlete to transfer weight to the blocking leg because they are trying to transfer the weight on an incline. If the athlete does not transfer his weight properly, he will fall backwards. If the athlete transfers his weight properly, he will take a step forward off of the ramp. The slope of the adjustable ramp 1 may be changed to provide differing exit heights 22 to change the level of difficulty for the athlete.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An athlete training apparatus, comprising:

a base having an outside perimeter;

a frame selectively configured at a ramp angle relative to the base and having an inside perimeter greater than the outside perimeter of the base;

a launch surface borne by the frame having an exit height and a front portion with an arcuate shape;

a pivot connection between the base and the frame;

a plurality of supports pivoted about a common axis configured to hold the frame at a selected discrete ramp angle;

a linkage system configured to maintain the supports in an approximately equal tilt angle; and a handle connected to the linkage system configured to position the supports, wherein the handle is engaged to pivot the plurality of supports into a desired configuration to select a desired exit height from which an athlete launches their body or athletic implement during training.

2. An athlete training apparatus as claimed in claim 1, further comprising;

a plurality of sets of stops connected to the frame, wherein each set of stops is associated with each support wherein each stop within the set being configured to hold the launch surface at one of several discrete exit heights.

3. An athlete training apparatus as claimed in claim 2, and wherein the exit height is selected from the group consisting of two inches, four inches, six inches, and eight inches.

4. An athlete training apparatus as claimed in claim 3, wherein the arcuate shape approximates the shape of a standard shot put circle.

5. An athlete training apparatus as claimed in claim 4, wherein the apparatus is comprised of light weight materials to allow the apparatus to be easily relocated.

6. An athlete training apparatus as claimed in claim 1, further comprising;

a plurality of channels formed into the base configured to hold the linkage system in position wherein each channel defines discrete exit heights.

7. An athlete training apparatus as claimed in claim 6, and wherein the exit height is selected from the group consisting of two inches, four inches, six inches, and eight inches.

8. An athlete training apparatus as claimed in claim 7, wherein the arcuate shape approximates the shape of a standard shot put circle.

9. An athlete training apparatus as claimed in claim 8, wherein the apparatus is comprised of light weight materials to allow the apparatus to be easily relocated.

* * * * *